US007212390B2

(12) United States Patent
Ouvry

(10) Patent No.: US 7,212,390 B2
(45) Date of Patent: May 1, 2007

(54) ELECTRONIC CONTROL CIRCUIT FOR A STARTING SWITCH OF A MOTOR VEHICLE

(75) Inventor: Eric Ouvry, Oullins (FR)

(73) Assignee: Valeo Equipements Electriques Moteur, Creteil (FR)

( * ) Notice: Subject to any disclaimer, the term of this patent is extended or adjusted under 35 U.S.C. 154(b) by 0 days.

(21) Appl. No.: 10/504,912

(22) PCT Filed: Mar. 25, 2003

(86) PCT No.: PCT/FR03/00934

§ 371 (c)(1),
(2), (4) Date: Aug. 18, 2004

(87) PCT Pub. No.: WO03/083288

PCT Pub. Date: Oct. 9, 2003

(65) Prior Publication Data

US 2005/0083631 A1 Apr. 21, 2005

(30) Foreign Application Priority Data

Mar. 29, 2002 (FR) ..... 02 03983

(51) Int. Cl.
*H01H 47/00* (2006.01)

(52) U.S. Cl. ..... 361/143; 37/10.6; 361/160

(58) Field of Classification Search ..... 361/143
See application file for complete search history.

(56) References Cited

U.S. PATENT DOCUMENTS 5,831,804 A * 11/1998 Vilou ..... 361/28
6,708,429 B1 * 3/2004 Vilou ..... 307/10.6
2002/0017260 A1 2/2002 Saito et al.

FOREIGN PATENT DOCUMENTS

| | | | |
|---|---|---|---|
| FR | 2 746 449 | | 9/1997 |
| FR | 2 749 451 | | 12/1997 |
| FR | 2 770 349 | | 4/1999 |
| FR | 2 795 884 | | 1/2001 |
| WO | WO 01/48372 | * | 7/2001 |

* cited by examiner

*Primary Examiner*—Robert L. DeBeradinis
*Assistant Examiner*—Luis E Roman
(74) *Attorney, Agent, or Firm*—Berenato, White & Stavish

(57) ABSTRACT

An electronic control circuit for a motor vehicle starter contacter includes a management unit (26) having:

first means for detecting the open or closed state of the power contact (20), and second means for regulating the power supply of the winding (18) during the starting cycle when the power contact (20) is still open after a predetermined period of time following commencement of the order for starting.

In order to obtain automatic elimination of any fault in the form of an insulation effect, due to dirt or to an insulating particle in the contact zone during the starting process, and to match the energy supplied to the contacter, the second means are so arranged as automatically to produce, during a period of time, a set of pulses which are delivered to the winding (18) in such a way as to reiterate actuation of the contacter (16) so long as the order for starting is maintained, and in order to modify the intensity of the power supplied to the winding (18) during the said period of time, or when the operator reiterates the demand for starting in the event of failure of the moving contact (20) to close.

7 Claims, 4 Drawing Sheets

ELECTRONIC CONTROL CIRCUIT FOR A STARTING SWITCH OF A MOTOR VEHICLE

TECHNICAL FIELD OF THE INVENTION

This invention relates to an electronic control circuit for a starter contacter for a motor vehicle, the said contacter comprising a power contact for supplying power to the electric motor of the starter, and at least one excitation winding for actuating the power contact between an open position and a closed position, the said control circuit including a management unit having:

- first means for detecting the open or closed state of the power contact,
- and second means for regulating the power supply to the winding during the starting cycle when the power contact is still open after a predetermined time after the commencement of the order for starting.

STATE OF THE ART

With reference to FIG. 1, a motor vehicle starter 10 comprises an electric motor 12 which is electrically connected to the positive terminal 14A of a power supply battery, through an interposed power contacter 16. The other terminal 14B of the battery 14, which is the negative terminal, is connected to earth.

The contacter 16 comprises at least one excitation winding 18 for actuating a moving contact 20, which co-operates with fixed contacts 22, 24 in such a way that, in normal operation, it occupies either an open position when the winding 18 is not energised, or a closed position in the case where the latter is being excited during starting of the motor vehicle. The fixed contact 22 of the contacter 16 is connected to the terminal 14A of the battery 14, while the other fixed contact 24 is connected to the terminal 12A of the motor 12. The other terminal 12B of the motor 12 is connected to earth.

Excitation of the winding 18 of the contacter 16 is governed by an electronic management unit 26, in the form particularly of a microprocessor, which is automatically supplied with the battery voltage. The ignition key interrupter 28, or ignition switch, is connected between the terminal 14A of the battery 14 and the control unit 26, for initiating the starting process when it is actuated.

The management unit 26 takes note of the voltage at the terminals of the fixed contacts 22, 24 so as to verify whether the contacter 16 is in the open or the closed state. The voltage is zero when the moving contact 20 is closed, and is not zero when the moving contact 20 is open.

FIG. 2 shows the pattern, or law, for the power supply to the contacter, which is described in the document FR-A-2 795 884, and it shows the development of a cyclic ratio of power supply voltage to the winding for normal operation of the contacter.

There may be many causes of failure of the moving contact 20 of the contacter 16 to close. Apart from mechanical causes they may be linked to the presence of non-conducting bodies at the surface of the contacts 22, 24, 20, in particular dust, insulating particles, dirt, oxidation products, and so on. In that case, it is no longer possible to make electrical contact within the contacter 16. The latter is faulty and the engine is unable to start because the electric starter motor 12 cannot be energised.

In the event of a malfunction of the contacter, holding the ignition key for too long a time in its starting position may give rise to over-heating of the contacter winding, or destruction of the power supply transistor.

Electronic control units for starters offer various functions, among which are the functions linked with:

- displacement of the moving core and moving contact of the contacter, and
- operation of the contact of the contacter and of the associated electric motor.

According to the document FR-A-2 795 884, to which reference may be made for the structure of the starter, the management unit is capable of governing the pattern of the power supplied to the excitation winding of the contacter so as to optimise displacement of the moving core as a function of the displacement of the starter pinion. The cyclic ratio is applied to the power transistor which is in series with the winding, the value of the said cyclic ratio being regulated by the management unit in response to the power supply voltage across the terminals of the starter and the resistance of the winding, which is dependent on temperature.

In the document FR-A-2 746 449, the management unit is capable of detecting whether the moving contact of the contacter is really closed or not, during the control phase. The excitation current of the control winding of the contacter is automatically interrupted or reduced when the moving contact of the contacter is still open at the end of a predetermined period of time after the commencement of the demanded power supply. Such control of the excitation current of the contacter prevents damage to the control transistor or winding.

In the documents FR-A-2 760 891 and FR-A-2 760 910, the microprocessor management unit includes means for blocking the transistor which supplies power to the contacter winding, in response to the value of the drop in voltage supply after the contacter has been closed.

The system thus goes into protected mode. In this kind of situation, the operator will try again, and, because the pattern of power supply of the contacter is unchanged, the system runs the risk of again remaining with the contact open because of the presence of foreign bodies in the contact gap.

OBJECT OF THE INVENTION

The object of the invention consists in providing a solution to malfunctioning of the contacter of a motor vehicle starter, by automatically eliminating any fault consisting of unwanted insulation or pollution of the contact zone during the starting process, and by matching the energy supplied to the contacter.

According to the invention, the apparatus is characterised in that the second means are arranged to produce automatically, during a period of time, a series of pulses delivered to the winding, in such a way as to reiterate activation of the contacter so long as the order for starting is maintained, and for modifying the intensity of the power supplied to the winding during the said period of time, or when the operator repeats the demand for starting in the event of non-closure of the moving contact of the contacter.

The power supply pulses for the winding act on the displacement of the moving core of the contacter, causing the moving contact to be propelled rapidly towards the fixed contacts. The repeated impact of the moving contact on the fixed contacts generates mechanical shocks which are capable of destroying any possible foreign body (such as dirt, oxidation product or insulating particles), and clean the contact zone of the contacter.

According to a feature of the invention, the excitation pulses delivered by the management unit comprise peaks having an adjustable cyclic ratio.

The management unit preferably has means for determining the cyclic ratio of the power supplied to the winding as a function of various parameters, in particular the temperature in the vicinity of the winding, the number of commands for starting issued through the ignition switch, and the value of the voltage supplied to the terminals of the battery or of the contacter in the open state.

BRIEF DESCRIPTION OF THE DRAWINGS

Further advantages and features will appear more clearly from the following description of one embodiment of the invention, which is given by way of non-limiting example and is shown in the attached drawings, in which.

DESCRIPTION OF A PREFERRED EMBODIMENT

Figure 3:
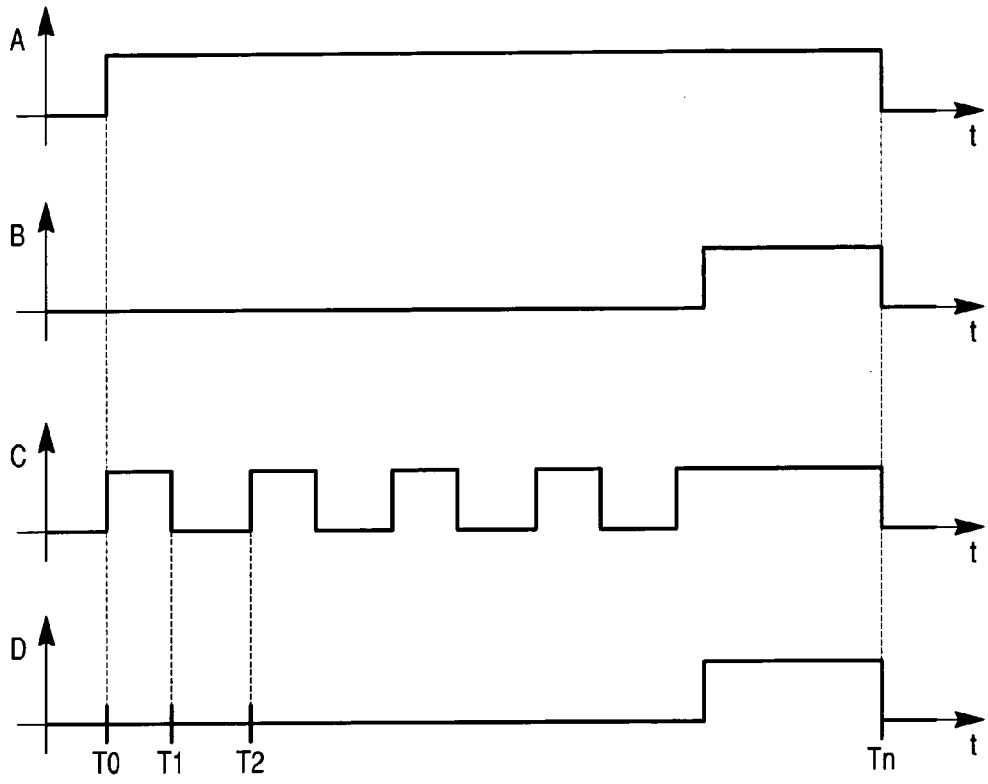
FIG. 3 consists of diagrams of various parameters in the event of failure of the contact to close on the first try, with governing of the contacter in accordance with the invention.
Figure 4:
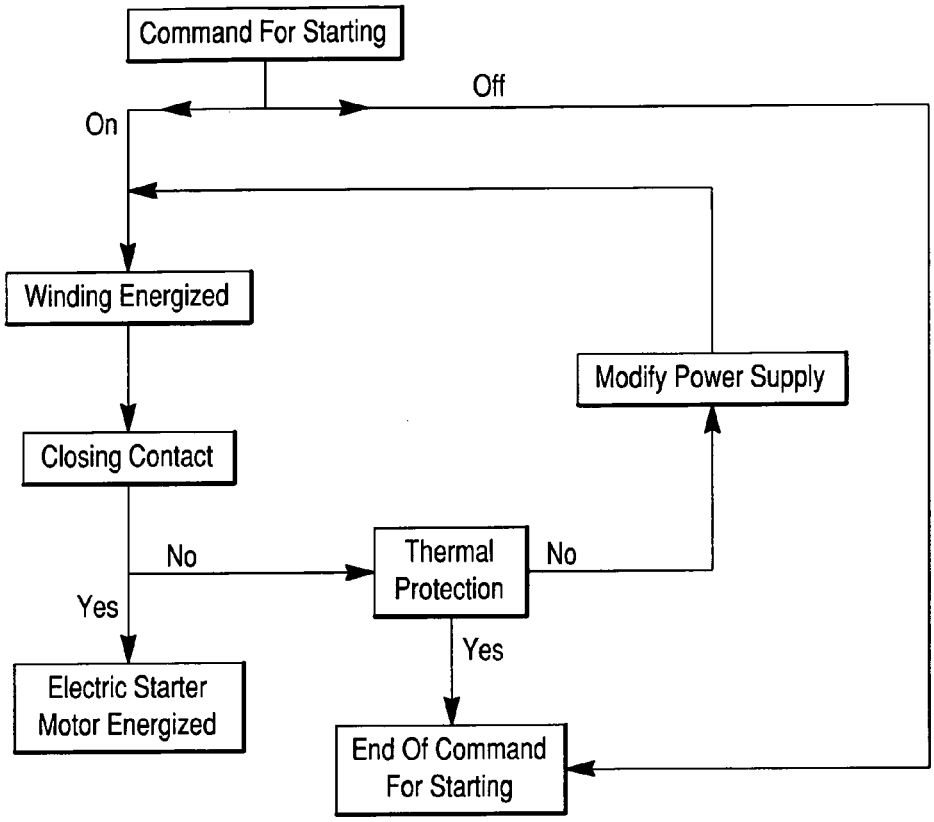
FIG. 4 is a contacter control diagram in the event of failure to close on the first try.
Figure 5:
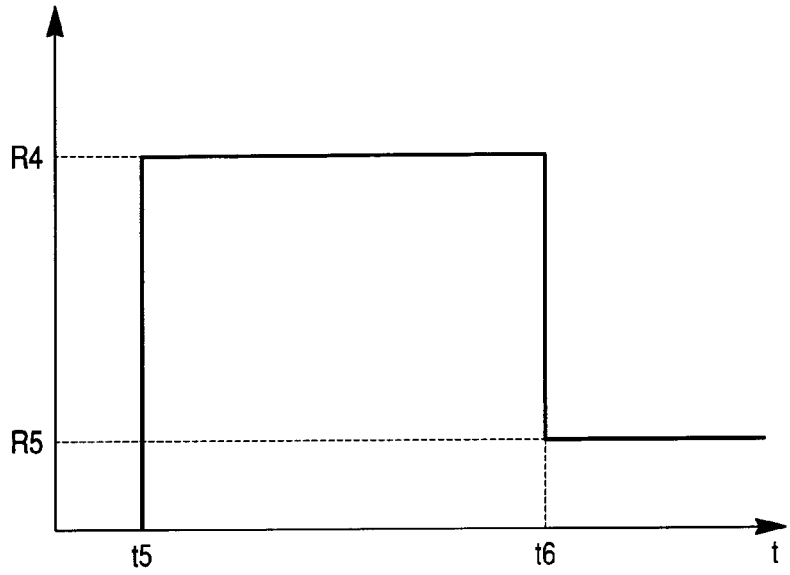
FIG. 5 shows a contacter power supply pattern in the event of failure of the contact to close.

With reference to FIGS. 3 to 5, the invention is applicable to systems which make use of a unit for managing control of the commands to the contacter, comprising power supply patterns to the winding 18 of the contacter 16, and detection that the contact 20 is open after it has been put into operation. During a malfunction of the starter in the event of non-closure of the moving contact 20 of the contacter 16, due to the presence of foreign bodies (such as dirt or particles), the invention consists in:

- firstly, reiterating the actuation of the contacter 16 by repeated pulses, so long as the operator requires the starting function and so long as the contact 20 is considered to be open,
- and secondly, modifying the power supply patterns of the contacter 16 during the operating mode described above, or when the operator is repeating his demand for starting in a predetermined period of time following failure of the contact 20 to close.

Figure 1:
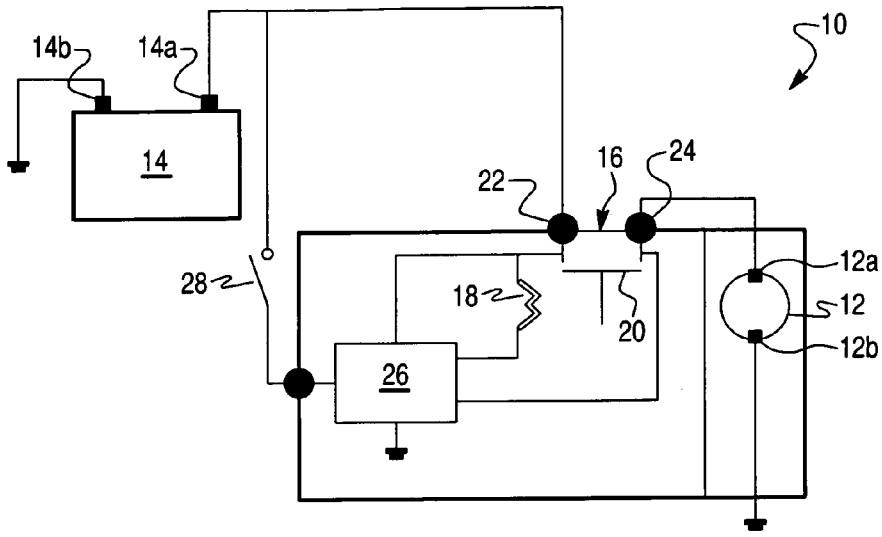
FIG. 1 is an electronic power supply circuit diagram for a contacter, for a motor vehicle in accordance with the state of the art.
Figure 2:
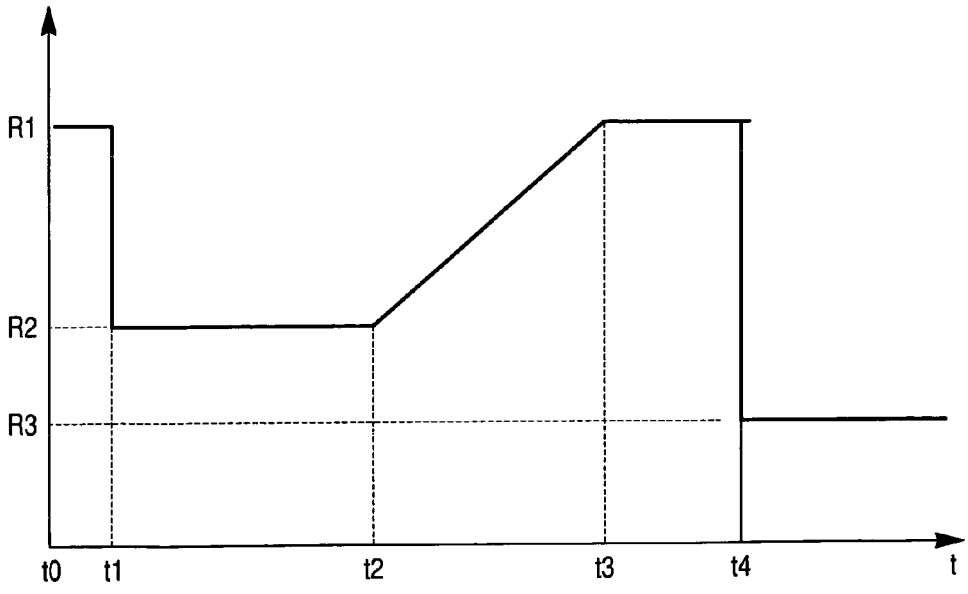
FIG. 2 shows a known power supply pattern for the contacter representing the development of a cyclic ratio of the power supply voltage for the winding in normal operation of the contacter.

After activation of the control following closure of the interrupter 28 (diagram A, FIG. 3), the control/command management unit 26 supplies power to the winding 18 of the contacter in accordance with a particular pattern which conforms with the development of the cyclic ratio of FIG. 2, as is described in the above mentioned document FR-A-2 795 884.

If the management unit 26 detects that the contact 20 has not closed (diagram B, FIG. 3), and if the command made by the ignition key 28 is maintained, the system then automatically emits a salvo of pulses (diagram C, FIG. 3) to the winding 18 of the contacter 16, so long as the contact 20 does not close. A thermal protection function may be added to this mode of operation in the event that the contact 20 has not closed.

There corresponds, to each power supply pulse of the winding 18, a displacement of the moving core of the contacter 16 which causes the moving contact to be propelled rapidly towards the fixed contacts 22, 24. In this way, the repeated impact of the moving contact 20 on the contacts 22, 24 can destroy any foreign body (such as dirt, oxidation product or insulating particles), and to clean the contact zone of the contacter 16. Thus, in diagram B, the contact closes and the winding 18 is supplied with power continuously (diagram C) for excitation of the motor 12. Opening of the interrupter 28 and contact 20 occurs at a time Tn.

In FIG. 3, the width of a salvo of pulses (T1–T0) corresponds, by way of example, to 200 ms. The gap between two successive pulses (T2, T1) is 50 ms. The total time (Tn–T0) between closure of the contact 20 and the initial instant at which control by the ignition switch 28 is activated, is less than 30 seconds before thermal protection occurs.

In this circuitry, it is proposed to match the power supply of the winding 18 as a function of parameters such as: temperature, the number of operations carried out, and supply voltage. The system is capable in certain cases of providing all the power from the battery 14.

When the operator interrupts control of starting prematurely by opening the ignition switch 28 during malfunctioning of the contacter 16, the power pulses have not had time to close the contact 20 correctly. Once the operator repeats his command within a predefined period of time, the management unit 26 matches the power supply of the winding 18 as a function of parameters such as: temperature, the number of operations carried out, and supply voltage. The power supply pattern, or law, is then modified in such a way that the system provides a sufficiently high level of energy to the moving core of the contacter 16 for the latter to transfer this energy to the moving contact 20, which will then violently impact on the foreign bodies in the contact zone.

One example of a control law is to restore all of the power from the battery 14 in the winding 18 of the contacter 16. In that case, the cyclic ratio of power supply voltage of FIG. 5 will be used, the cyclic ratio being the ratio between the conduction time of the transistor (not shown) which is in series with the winding 18, and the total duration of a cycle. The cyclic ratio R4 between the instants t5 and t6 is constant, and enables high intensity current to flow in the winding 18. The time interval t5–t6 is greater than the time interval t0–t1 of FIG. 2. The cyclic ratio R5 beyond the instant t6 substantially corresponds to the cyclic ratio R3 in FIG. 2.

Such an operating cycle enables faults due to incidental contact insulation (such as oxidation products, insulating dusts, dirt and so on) to be automatically eliminated and controlled, the operator not having to try doing anything about it.

The invention claimed is:

1. An electronic control circuit for a starter contacter for a motor vehicle, the said contacter (16) comprising a power contact (20) for supplying power to the electric motor (12) of the starter (10), and at least one excitation winding (18) for actuating the power contact (20) between an open position and a closed position, the said control circuit including a management unit (26) having:

- first means for detecting the open or closed state of the power contact (20),
- and second means for regulating the power supply to the winding (18) during the starting cycle when the power contact (20) is still open after a predetermined time after the commencement of the order for starting, wherein the second means are arranged to produce automatically, during a period of time, a series of pulses delivered to the winding (18), in such a way as to reiterate activation of the contacter (16) so long as the order for starting is maintained, and for modifying the intensity of the power supplied to the winding (18) during the said period of time, or when the operator repeats the demand for starting in the event of non-closure of the moving contact (20).

2. An electronic control circuit for a contacter according to claim 1, wherein the excitation pulses delivered by the management unit (26) comprise peaks having an adjustable cyclic ratio.

3. An electronic control circuit for a contacter according to claim 2, wherein the management unit (26) has means for determining the cyclic ratio of the power supplied to the winding (18) as a function of various parameters.

4. An electronic control circuit for a contacter according to claim 3, wherein said cyclic ratio depends on the temperature in the vicinity of the winding (18).

5. An electronic control circuit for a contacter according to claim 3, wherein said cyclic ratio depends on the number of commands for starting issued through the ignition switch (28).

6. An electronic control circuit for a contacter according to claim 3, wherein said cyclic ratio depends on the value of the voltage supplied to the terminals of the battery (14) or of the contacter (16) in the open state.

7. An electronic control circuit for a starter contacter for a motor vehicle, said contacter (16) comprising a power contact (20) for supplying power to the electric motor (12) of the starter (10), and at least one excitation winding (18) for actuating the power contact (20) between an open position and a closed position, said control circuit including a management unit (26) configured to detect the open or closed state of the power contact (20), and to regulate the power supply to the winding (18) during the starting cycle when the power contact (20) is still open after a predetermined time after the commencement of the order for starting, wherein the management unit is configured to produce automatically, during a period of time, a series of pulses delivered to the winding (18), in such a way as to reiterate activation of the contacter (16) so long as the order for starting is maintained, and for modifying the intensity of the power supplied to the winding (18) during the said period of time, or when the operator repeats the demand for starting in the event of non-closure of the moving contact (20).

* * * * *